United States Patent [19]

Brandl et al.

[11] Patent Number: 4,728,225

[45] Date of Patent: Mar. 1, 1988

[54] METHOD OF REHABILITATING A WATERFRONT BULKHEAD

[75] Inventors: Ernest D. Brandl, Houston, Tex.; Robert C. Houghton, Bedford, N.H.

[73] Assignee: Schnabel Foundation Company, Bethesda, Md.

[21] Appl. No.: 843,923

[22] Filed: Mar. 21, 1986

Related U.S. Application Data

[63] Continuation of Ser. No. 700,800, Feb. 11, 1985, abandoned.

[51] Int. Cl.[4] ..... E02D 29/02; E21D 20/02

[52] U.S. Cl. ..... 405/262; 405/284; 405/285

[58] Field of Search ..... 405/31, 258, 260, 262, 405/272, 274, 276, 284, 285, 286, 287

[56] References Cited

U.S. PATENT DOCUMENTS

| | | | |
|---|---|---|---|
| 982,697 | 1/1911 | Upson | 405/286 |
| 1,083,289 | 1/1914 | Mason . | |
| 1,270,659 | 6/1918 | Ravier . | |
| 1,298,101 | 3/1919 | Sands | 405/262 |
| 1,693,311 | 12/1928 | Miller et al. . | |
| 1,907,135 | 5/1933 | Wemlinger et al. | 405/285 |
| 1,965,169 | 7/1937 | Becker . | |
| 2,902,743 | 9/1959 | King | 405/284 X |
| 3,381,483 | 7/1968 | Huthsing . | |
| 3,548,603 | 12/1970 | Spinna et al. | 405/284 |
| 3,739,588 | 6/1973 | Schroter et al. . | |
| 4,369,004 | 1/1983 | Weatherby | 405/262 |
| 4,480,945 | 11/1984 | Schnabel | 405/262 |

FOREIGN PATENT DOCUMENTS

| | | | |
|---|---|---|---|
| 2942428 | 4/1981 | Fed. Rep. of Germany | 405/285 |

*Primary Examiner*—Cornelius J. Husar
*Assistant Examiner*—Nancy J. Stodola
*Attorney, Agent, or Firm*—Banner, Birch, McKie & Beckett

[57] ABSTRACT

A method for rehabilitating an existing bulkhead located between a body of water and land is disclosed. The method includes the steps of installing a plurality of tiebacks attached directly to the existing bulkhead, and a new bulkhead facing is connected to the existing bulkhead which has been supported by the tiebacks. An alternate method includes the steps of installing a plurality of substantially vertical piles at horizontally spaced locations in front of, i.e. on the water side of, the existing bulkhead; connecting the vertical piles to the existing bulkhead; installing tiebacks through the existing bulkhead and into the land behind the existing bulkheads; and connecting the tiebacks to the vertical piles. In situations where use of piles and tiebacks alone are not sufficient to rehabilitate the bulkhead, a new bulkhead facing is installed in front of the existing bulkhead and connected to and supported by the piles and tieback supported existing bulkhead.

2 Claims, 8 Drawing Figures

METHOD OF REHABILITATING A WATERFRONT BULKHEAD

This application is a continuation of Ser. No. 700,800, filed Feb. 11, 1985, now abandoned.

TECHNICAL FIELD

The present invention relates to the field of construction wherein bulkheads are used to separate a body of water from land. More particularly, the present invention relates to a method for rehabilitating an existing bulkhead wherein rehabilitation is required for reasons including corrosion, impact, structural failure of the existing bulkhead, any increase in either the channel depth or the height of the earth fill directly adjacent to the bulkhead, or where it is desired to construct a new bulkhead on the water side of the existing bulkhead in order to enlarge a wharf or pier.

BACKGROUND OF THE INVENTION

Numerous types of bulkheads have been used to divide a body of water from land, i.e., to support the earth and to maintain a water-earth boundary. FIG. 1 illustrates one type of prior art bulkhead 10A which divides a body of water 11A from land 13A. Bulkhead 10 includes generally vertical facing or piling 12A which is formed of either concrete, steel or wood. The bottom edge of piling 12A is driven or inserted into the channel bottom. In situations where the water is relatively shallow and the wall is very short, driving the bottom edge of the piling into the channel bottom sufficiently supports the bulkhead to retain or hold back the ground from the water. However, if the water is deep and the bulkhead is high, additional support for the bulkhead is required. FIG. 1 illustrates a typical technique for providing the additional support wherein a tie rod 14A is connected at one of its ends to piling 12A through a wale 21A and at its other end to a dead man 16A. Support piles 18A may also be attached to dead man 16A to provide further support.

Another technique for providing additional support to a bulkhead is through the use of tiebacks inserted at angles below horizontal through a wall and into the adjacent ground. The tiebacks are fixed into the ground, post-tensioned, and secured to the bulkhead. In each of these cases, the bulkhead is designed to provide a vertical span between the tie rods and the soil below the water, while the wale is designed to provide a horizontal span between the tie rods or tiebacks. Thus, the strength exhibited by the bulkhead is limited by its design and the depth of the water.

FIG. 2 illustrates a typical prior art technique for rehabilitating bulkhead 10A. Rehabilitation of a bulkhead 10A is required because of a failure or break 15A in tie rod 14A. However, rehabilitation of a bulkhead may be necessitated by other reasons including deterioration or corrosion in the bulkhead facing, raising the earth adjacent to the bulkhead, or a deepening of the channel bottom. In the illustrated rehabilitation technique, a new bulkhead 20A is installed a predetermined distance in front of, i.e., to the water-side, original bulkhead 10A. Bulkhead 20A includes piling 22A which is driven or inserted into the channel bottom to provide the toe for the lower end support of bulkhead 20A. Support at the upper end of bulkhead 20A is provided by a tieback 24A which is attached to a wale adjacent to the upper end of pile 22A. Tieback 24A extends toward the land-side at an angle below the horizontal through the original bulkhead 10A and into the ground behind bulkhead 10A.

In this technique the sequence of installation requires backfilling after installing the tiebacks. Since the tiebacks are installed prior to backfilling, the expensive technique of working from a barge or trestle may be required. Also, backfilling over and around a tendon or tiebacks may result in flexure and tensioning of the tieback, thereby increasing the chance of tieback failure. Another disadvantage of this rehabilitation technique is that temporary support of the new bulkhead during testing of the tiebacks is usually required. This technique in contrast to the bulkhead rehabilitaion technique disclosed herein, derives no residual value from the existing bulkhead since the existing bulkhead is not incorporated into the new structural system.

Another bulkhead rehabilitation technique is disclosed in U.S. Pat. No. 4,480,945 issued to Harry Schnabel, Jr. on Nov. 6, 1984, the U.S. Pat. No. 4,480,945 discloses a technique where tiebacks are installed in the bulkhead being rehabilitated. A sufficient number of tiebacks are installed so that all the additional required support is provided by the tiebacks. While the technique disclosed in the U.S. Pat. No. 4,480,945 is an advance over the previously discussed bulkhead rehabilitation technique since it is substantially less expensive and utilizes the existing bulkhead, in some situations a new bulkhead facing may be desired or the original bulkhead may be so severely deteriorated that tieback rehabilitaion alone would be insufficient.

SUMMARY OF THE INVENTION

One embodiment of the present invention is directed to a method for rehabilitating an existing bulkhead located between a body of water and land which includes the steps of:

installing a tieback through the existing bulkhead, installing a new bulkhead facing in front of the original bulkhead and connecting the new bulkhead to the tieback-supported existing bulkhead by a generally horizontally extending tie rod.

In situations where the existing bulkhead is not sufficiently sound to support the loads imposed upon it by the tiebacks, another embodiment of the present invention includes the steps of: installing a plurality of substantially vertical piles at horizontally spaced locations in front of, i.e. on the water side of, the exisitng bulkhead; connecting the vertical piles to the existing bulkhead; installing tiebacks through the existing bulkhead and into the land behind the existing bulkheads; and connecting the tiebacks to the vertical piles.

In some cases, depending upon the actual condition of the existing bulkhead, construction of a new facing may not be necessary and the existing bulkhead is rehabilitated by the vertical piles. However, in situations where use of piles and tiebacks alone is not sufficient to rehabilitate the bulkhead, a new bulkhead facing is installed in front of the existing bulkhead and connected to the existing bulkhead which has been supported with tiebacks or tiebacks and piles.

In one such technique, the new bulkhead facing is installed by inserting the bottom of the facing into the earth below the body of water at a predetermined horizontal distance from the vertical piles with the facing extending generally vertically upward to a level above the water; securing connecting members between the vertical piles and the new bulkhead facing; and backfilling with soil the area between the existing bulkhead and the new bulkhead facing.

In another technique for installing a new bulkhead facing, panels are secured directly to the vertical piles.

Where the level of the land is raised behind the existing bulkhead, the present invention can be utilized by installing vertical piles which extend upward above the existing structure to the new ground level, and attaching panels to the upper end of the vertical piles so as to retain the increased height of the land.

The use of vertical piles in the rehabilitation of bulkheads, either with or without the installation of a new bulkhead facing, attains certain distinct advantages. For example, when vertical piles are used, they accept the vertical loading applied by the tiebacks so that no vertical load is transmitted to the bulkhead being rehabilitated. Thus, this technique can be used to rehabilitate even those bulkheads which have no capacity to resist vertical loading. The vertical piles also spread out the tieback load, thereby distributing the load over the entire contact area between the piles and the existing bulkhead so that the piles may be used to rehabilitate even those bulkheads which have no capacity to resist concentrated loads.

The connection between the vertical piles and the existing bulkhead can be extremely simple and can consist primarily of shims or wedges where required to establish contact between the vertical piles and the existing bulkhead. The vertical piles thus can be used on bulkheads where connection to the existing structure is difficult due to the effects of corrosion or other types of deterioration to the bulkhead.

In some situations, a new bulkhead facing is not required since the vertical piles add sufficient support to the existing bulkhead structure without exceeding the ability of the existing structure to withstand the applied loads. One such situation could arise when the channel adjacent to the bulkhead is to be deepened and the vertical piles attain the additional toe embedment which is required for mass stability. Another such situation could arise when the height of the ground on the land side of the existing bulkhead is to be increased and the piles are installed as to protrude the desired distance above the existing bulkhead structure. Similarly, where only tiebacks are used, they also are not subjected to damage during backfilling or because of settlement.

However, in situations where a new bulkhead facing is desired or required, the present technique of installing a new bulkhead facing at a spaced location in front of the original bulkhead also exhibits advantages over the conventional installation technique illustrated in FIG. 2. In the present invention, the tieback is connected to the original bulkhead, rather than to the new bulkhead so that advantage can be taken of the soil mass behind the existing bulkhead during testing of the tiebacks. Excessive deflection of the new bulkhead facing, which resulted from using the traditional technique, is thus prevented. Since the tieback tendon is located totally behind the existing bulkhead, it will not be exposed to damage due to backfilling operations or settlement. Also, since the present technique connects the new bulkhead facing to the original bulkhead by a tie rod rather than by a tieback, any grade of steel can be used rather than high strength steel. No downward component of force is exerted on the new bulkhead facing since the tie rods connecting it to the original bulkhead are horizontally disposed, rather than angled downward as in the conventional technique.

Various advantages and features of novelty which characterize the invention are pointed out with particularity in the claims annexed hereto and forming a part hereof. However, for a better understanding of the invention, its advantages and objects obtained by its use, reference should be had to the drawings which form a further part hereof, and to the accompanying descriptive manner in which there are illustrated and described several embodiments of the invention.

DETAILED DESCRIPTION OF THE INVENTION

Figure 1:
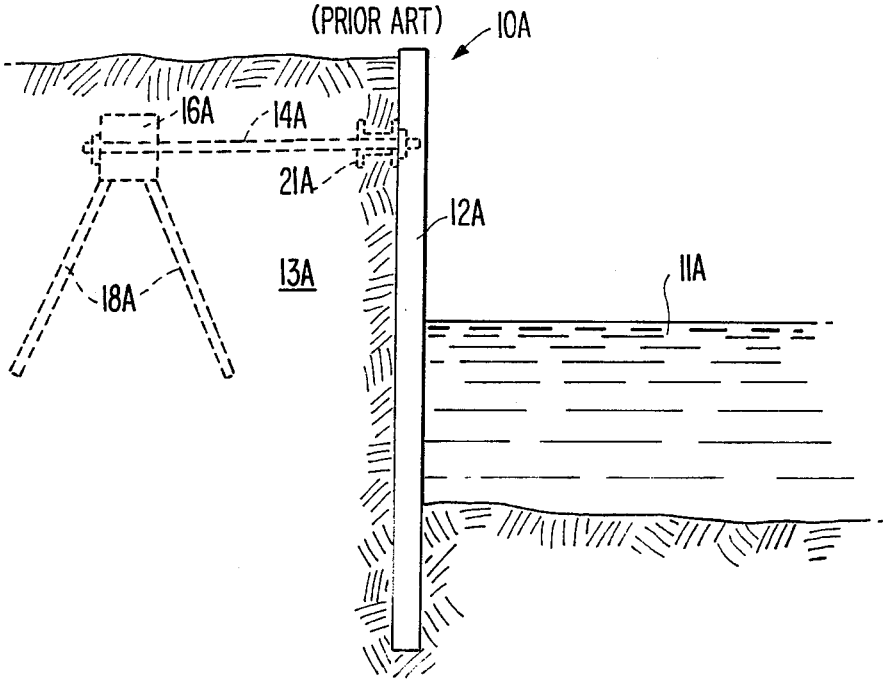
FIG. 1. (PRIOR ART)
FIG. 1 is a schematic sectional view of a prior art bulkhead.
Figure 2:
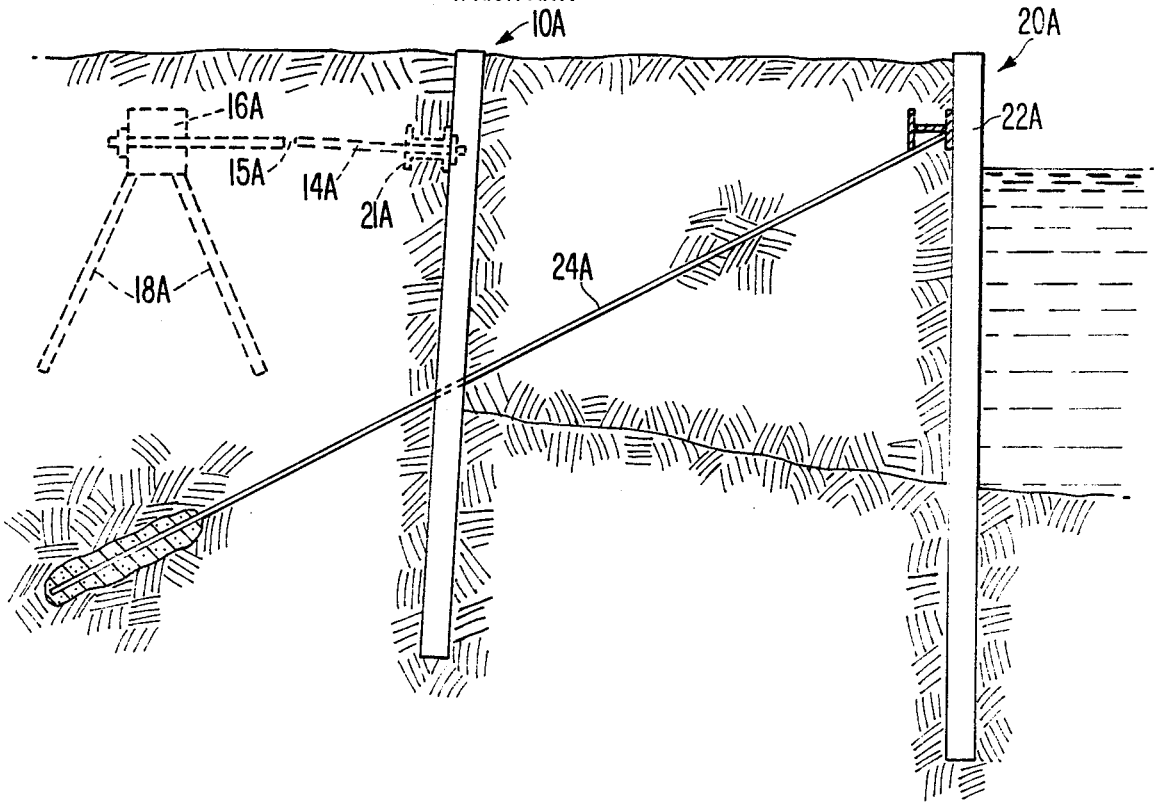
FIG. 2. (PRIOR ART)
FIG. 2 is a schematic sectional view of a prior art technique for the rehabilitation of the existing bulkhead illustrated in FIG. 1 by the installation of a new bulkhead facing.
Figure 3:
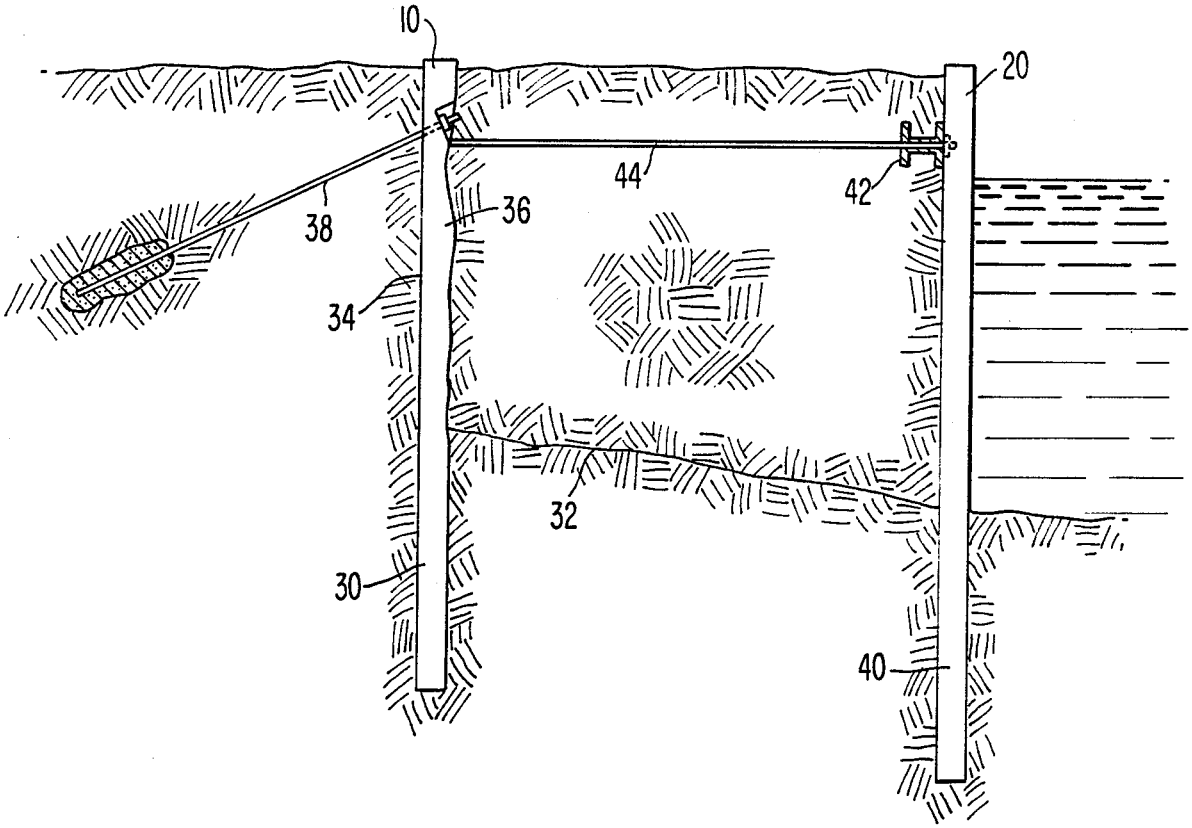
FIG. 3 is a schematic sectional view illustrating a bulkhead rehabilitation technique in accordance with the present invention.

Referring to drawings, wherein like numerals indicate like elements, there is shown in FIG. 3 a bulkhead rehabilitated by the installation of a new bulkhead facing according to a technique of the present invention. An existing bulkhead 10 has a toe portion 30 which is inserted below the channel bottom 32, a back-land facing side 34, and a forward-water facing side 36. Bulkhead 10 is shown in its rehabilitated or reinforced condition wherein tiebacks 38, one of which is shown in FIG. 3, are installed through bulkhead 10 adjacent to its upper end and into the land or earth behind it at an angle below the horizontal. Tiebacks 38 are installed in a conventional manner wherein they are tensioned and are secured to bulkhead 10. A new bulkhead facing 20 is installed in front of bulkhead 10 and has a toe portion 40 which is embedded below channel bottom 32. New bulkhead facing 20 is vertically oriented and is located a predetermined distance in front of bulkhead 10. A wale 42 is attached to new bulkhead facing 20 adjacent its upper end, and a connecting member such as a tie rod 44 is connected between wale 42 and bulkhead 10, which is provided with additional support by tiebacks 38. Tie rod 44 is thus preferably located near the upper ends of bulkhead 10 and bulkhead facing 20, and extends in a generally horizontal direction. The area between the bulkheads is backfilled. FIG. 3 is a sectional view whereby it should be understood that a plurality of tiebacks 38 and tie rods 44 are located at spaced locations along the respective bulkheads. New bulkhead facing 20 can be formed with conventional material, such as wood piling, or metal or concrete panels. Backfilling of the area between bulkhead 10 and new bulkhead facing 20 generally occurs, after tie rods 44 are installed. However, if toe 40 is sufficient to support the soil during backfilling, backfilling, up to the level of the tie rods, can occur prior to the installation of tie rods 44.

Figure 4:
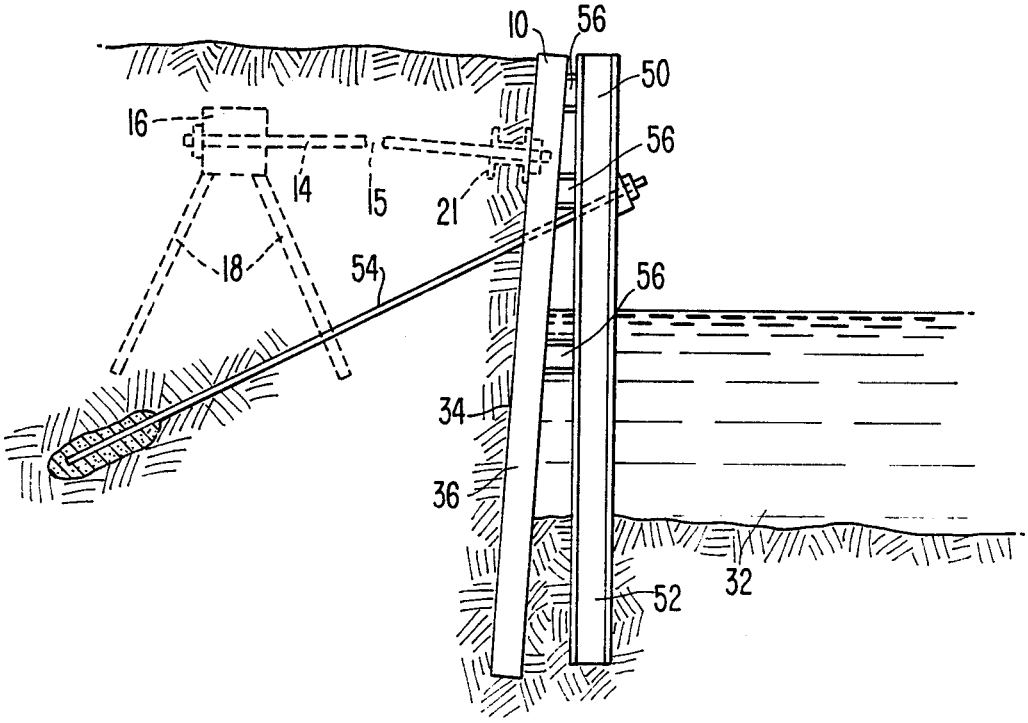
FIG. 4 is a schematic sectional view illustrating another embodiment of bulkhead rehabilitation technique in accordance with te present invention.

FIG. 4 illustrates another embodiment of the present invention wherein a new bulkhead facing is not installed, but rather the existing bulkhead 10 is rehabilitated by the installation of a plurality of vertical piles 50. Piles 50 can be conventional soldier or king piles. Piles 50 include toe portions 52 which are embedded below channel bottom 32. Piles 50 are located at spaced locations along front face 36 of existing bulkhead 10. A plurality of tiebacks 54 are installed extending through bulkhead 10 and secured to the earth in a conventional manner. Tiebacks 54 are also attached to piles 50, rather than to the existing bulkhead 10. Tiebacks 54 are installed through bulkhead 10 preferably adjacent its top, and are attached to piles 50 adjacent its top, preferably above the water level. Piles 50 are connected to bulkhead 10 by wedges or shims 56 which can simply be friction fit between bulkhead 10 and piles 50, or can be more firmly affixed in any conventional manner such as welding. In FIG. 4, rehabilitation was necessitated by a failure or break 15 in tie rod 14, which is connected to the rear side of bulkhead 10 through wale 21. Of course, the other reasons discussed above could also necessitate the rehabilitation of bulkhead 10.

Figure 5:
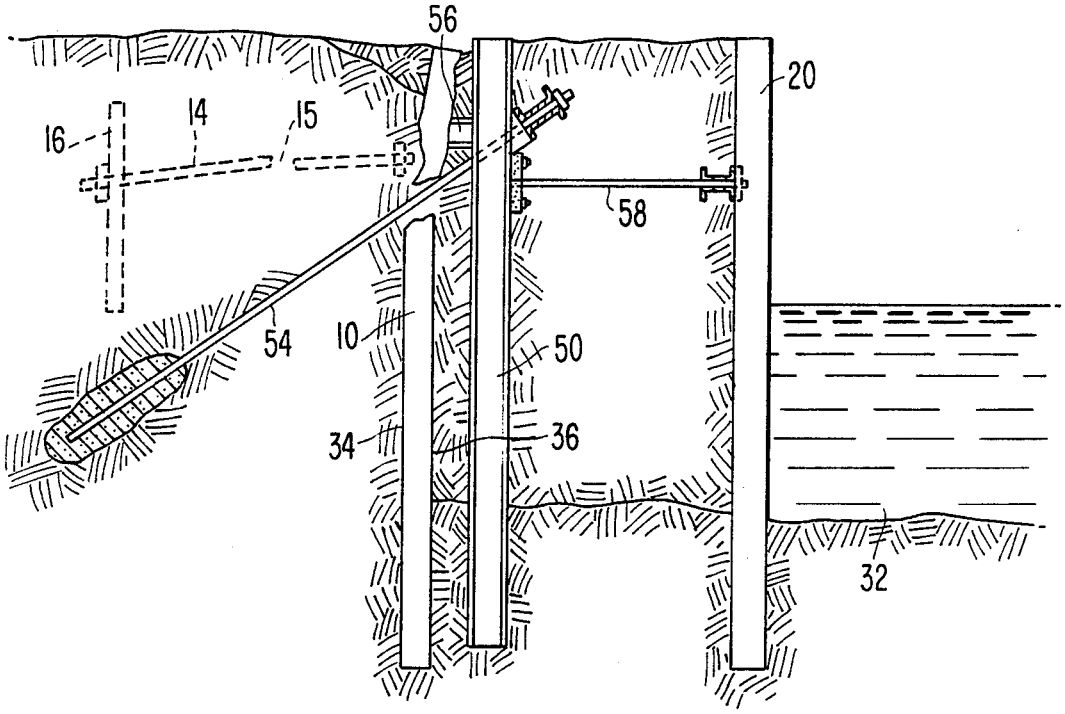
FIG. 5 is a schematic sectional view illustrating another embodiment of bulkhead rehabilitation technique in accordance with the present invention.

FIG. 5 illustrates a further embodiment of the present invention wherein rehabilitation of existing bulkhead 10 includes the installation of new bulkhead facing 20, in addition to the installation of piles 50 in the manner discussed with reference to FIG. 4. New bulkhead facing 20 is attached to the vertical piles 50 by tie rods 58 which extend in a horizontal direction between new bulkhead facing 20 and piles 50 and adjacent their upper ends. FIG. 5 illustrates a more severe deterioration of existing bulkhead 10 which includes breakage of both tie rods 14 and the water facing side of the bulkhead itself. In this case the simple use of piles 50 would be insufficient to rehabilitate the existing bulkhead.

Figure 6:
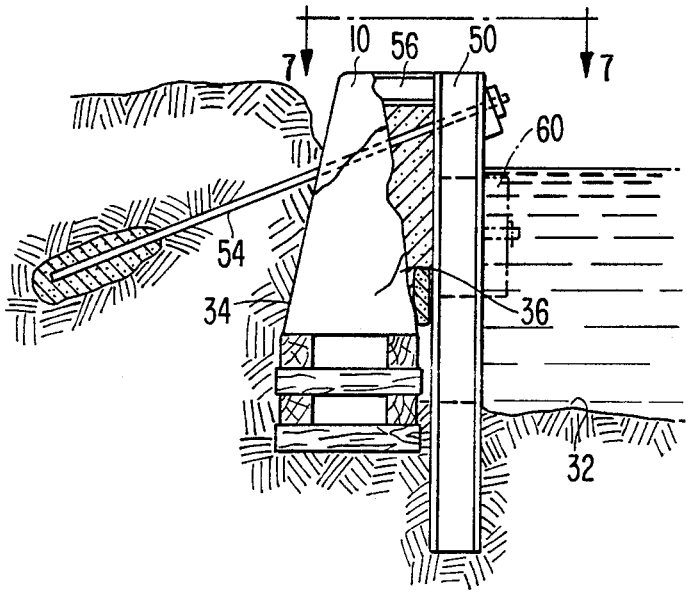
FIG. 6 is a schematic sectional view illustrating a further embodiment of a bulkhead rehabilitation technique in accordance with the present invention.
Figure 7:
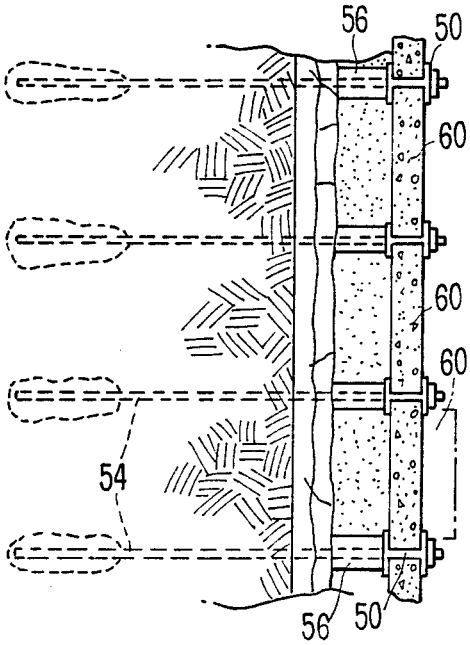
FIG. 7 is a view taken along lines 7—7 of FIG. 6.

FIGS. 6 and 7 illustrates a further embodiment of the present invention wherein a new bulkhead facing is required. In this embodiment, new bulkhead facing panels 60 are attached directly to piles 50. Piles 50 are installed in the manner illustrated in FIG. 4. Panels 60 can be formed of any conventional material such as concrete, metal or wood and can be attached to the piles 50 in any conventional manner, such as by bolting, placing within the flanges of piles 50, or through shear stud connections. Panels 60 are shown connected between adjacent piles 50 in full line and to the front of face of piles 50 in phantom line.

Figure 8:
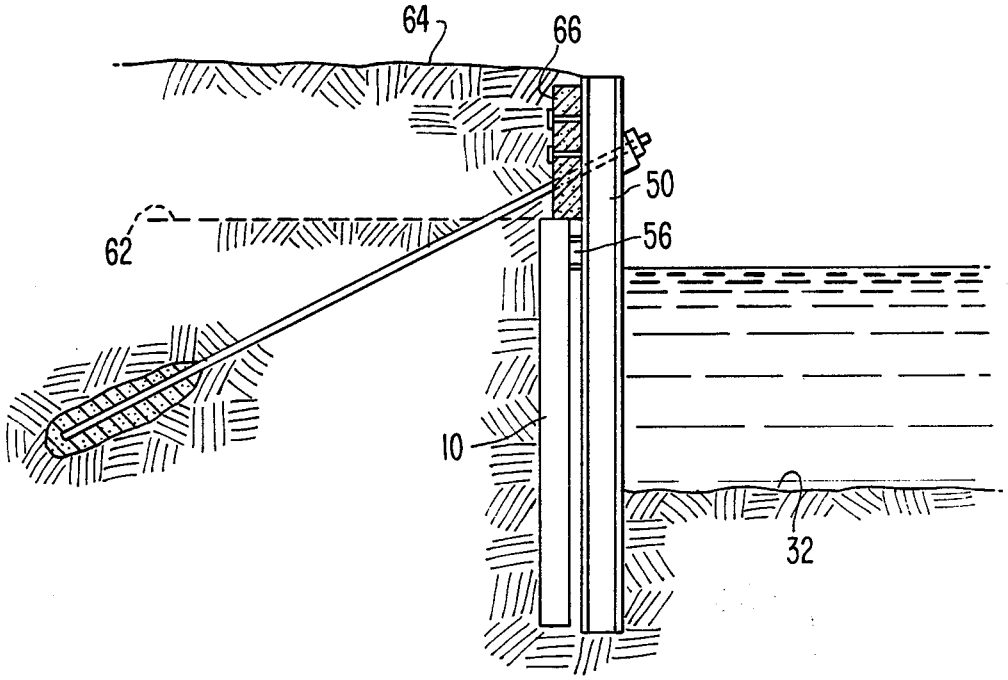
FIG. 8 is a schematic sectional view illustrating a further embodiment of bulkhead rehabilitation technique in accordance with the present invention.

FIG. 8 illustrates an embodiment of the invention wherein the original ground surface level 62 is to be raised to a new ground surface level 64. Piles 50 are installed in the manner illustrated in FIG. 4 so as to protrude the desired distance above the existing structure. A plurality of panels 66 are attached to the rear face of the protruding portion of piles 50. Alternatively, panels 66 can be attached between adjacent piles 50. Panels 66 thus support the additional earth fill between the original ground surface 62 and new ground surface 64.

The above specification has referred to the use of a plurality of various elements such as tie rods, tiebacks, and piles. FIG. 7 illustrates a plurality of tiebacks and piles, while the remaining drawings illustrate singular elements along a sectional view for the purpose of simplicity. It should be understood that a plurality of these elements would be used in all the embodiments, dependent on the length of bulkhead to be rehabilitated.

Numerous characteristics and advantages of the invention have been set forth in the foregoing description, together with details of the structure and function of the invention and novel features thereof are pointed out in the appended claims. The disclosure, however, is illustrative only, and changes may be made in detail, especially in the manner of shape, size and arrangement of parts within the principle of the invention, to the full extent indicated by the broad general meaning in which the appended claims are expressed.

I claim:

1. A method of rehabilitating an existing bulkhead located between a body of water and land comprising the steps of:

(a) reinforcing the existing bulkhead by:
  (i) installing a plurality of substantially vertical piles at horizontally spaced locations in front of the existing bulkhead;
  (ii) connecting said vertical piles to the existing bulkhead;
  (iii) installing tiebacks through the existing bulkhead and into the land behind the existing bulkhead; and
  (iv) connecting the tiebacks to the vertical piles;

(b) installing a new bulkhead facing a predetermined distance in front of the existing bulkhead and supporting the new bulkhead in part with the reinforced existing bulkhead by:
  (i) inserting the bottom of said facing into the earthen bottom below the body of water;
  (ii) securing connecting members between said vertical piles and said new bulkhead facing; and
  (iii) backfilling the area between the existing bulkhead and said new bulkhead facing.

2. A method in accordance with claim 1 wherein said facing extends generally vertically upward to a level above the body of water, and said connecting members are installed and secured between said vertical piles and said new bulkhead facing in a substantially horizontal orientation adjacent the top of said piles and facing.

* * * * *